United States Patent [19]

Field

[11] Patent Number: 4,898,285

[45] Date of Patent: Feb. 6, 1990

[54] MERCHANDISE RACK COVERING SYSTEM

[76] Inventor: Frank P. Field, 854 Napoli Dr., Pacific Palisades, Calif. 90272

[21] Appl. No.: 279,207

[22] Filed: Dec. 2, 1988

[51] Int. Cl.[4] ..... A47F 5/00

[52] U.S. Cl. ..... 211/183; 52/727

[58] Field of Search ..... 211/183, 182, 187, 193; 248/345.1; 52/727, 728, 211; 160/135, 351

[56] References Cited

U.S. PATENT DOCUMENTS

| | | | |
|---|---|---|---|
| 3,131,792 | 5/1964 | Groneman et al. | 52/727 X |
| 3,728,833 | 4/1973 | Grossman | 52/211 |
| 4,461,461 | 7/1984 | Caron | 256/19 |
| 4,585,131 | 4/1986 | Crossman et al. | 211/183 X |
| 4,716,699 | 1/1988 | Crossman et al. | 52/36 X |

*Primary Examiner*—Alvin C. Chin-Shue
*Assistant Examiner*—Sarah A. Lechok
*Attorney, Agent, or Firm*—Stetina and Brunda

[57] ABSTRACT

An improved merchandise rack covering system is disclosed characterized by use of an extruded cover element and corner element which may be rapidly positioned upon the affixed to a merchandise display rack to modify the aesthetics of the merchandise rack. The cover and corner elements are sized to be frictionally retained upon the merchandise rack and are each provided with an internal spacer member which accurately registers the cover and corner elements upon the merchandise rack. By use of the improved merchandise rack covering system of the present system, conventional merchandise racks can be rapidly modified to possess modern contemporary aesthetics as well as different colors to aid in the marketing of merchandise maintained upon the merchandise rack.

10 Claims, 1 Drawing Sheet

12
14
32
16E
22
10
14
32
16B
16A
16D
22
12
16C 10
14
32
30
34
16
22
16
18
12
20
21

32
22
16
14
12
5
14
5
12B
14
12A
12C
21

21
14
32
18
16
18
21
18

MERCHANDISE RACK COVERING SYSTEM

FIELD OF THE INVENTION

The present invention relates generally to an apparatus for displaying merchandise for sale in retail and commercial establishments and more particularly to an improved merchandise rack covering system characterized by use of an extruded cover element and corner element which may be rapidly positioned upon and affixed to a merchandise rack to modify the aesthetics of the merchandise rack.

BACKGROUND OF THE PRESENT INVENTION

As is well known, a variety of commercial marketing display systems are currently being utilized in the trade to market merchandise to the public. With competition between establishments becoming increasingly more intense, the importance of aesthetics and utility of such display racks has been recognized with such display systems often times providing the critical difference in persuading consumers to purchase displayed products.

Additionally, however, due to the intense competition existing between commercial and retail establishments, the costs of such display systems has become critical with large national retail and commercial establishments typically requiring standardization of merchandise racks to maintain capital costs to a minimum. One such merchandise rack that has gained substantial usage in commercial and retail display applications comprises a conventional tubular metal rack system often times known as a tandem rack which include a plurality of elongate slots formed on the front side thereof adapted to receive plural shelves or struts to support merchandise thereon. Although such conventional metal racks possess substantial strength and cost benefits to be widely utilized in the trade, they additionally are somewhat unsightly in use rendering the display systems more conducive for warehouse applications as opposed to retail-oriented display use.

As such there exists a substantial need in the art for an apparatus and method of retrofitting conventional metal rack/tandem rack display systems to include better aesthetics suitable for commercial/retail establishments which further may be rapidly mounted upon the conventional metal racks to meet the diversity associated in modern display systems.

SUMMARY OF THE PRESENT INVENTION

The present invention is specifically designed to alleviate the above-referenced deficiencies associated in the prior art. More particularly, the present invention comprises an improved merchandise rack covering system characterized by use of a cover element and corner element which may be rapidly positioned upon and affixed to a conventional metal merchandise rack to modify the aesthetics of the merchandise rack. In the preferred embodiment, the cover and corner elements are frictionally retained upon the merchandise rack and are provided with internal spacer members which automatically accurately register the cover and corner elements upon the merchandise rack.

In the preferred embodiment, the cover and corner elements are manufactured from a thermo-plastic polyvinylchloride material which is conducive to extrusion and/or molding fabrication techniques. Additionally such material may be fabricated in differing colors to enable the covering system to be utilized in differing decors encountered in commercial and retail merchandising establishments.

When positioned upon the conventional metal merchandise rack, the merchandise rack covering system of the present invention transforms the merchandise rack into an aesthetically pleasing merchandise system having modern or contemporary styling. Further, the improved merchandise rack covering system of the present invention is maintained upon the conventional rack without any auxillary fasteners thereby enabling the system to be rapidly mounted and removed from the display rack as desired.

DESCRIPTION OF THE DRAWINGS

These as well as other features of the present invention will become more apparent upon reference to the drawings wherein.

DETAILED DESCRIPTION OF THE PREFERRED EMBODIMENT

Figures 1, 2, 3, 4, 5:
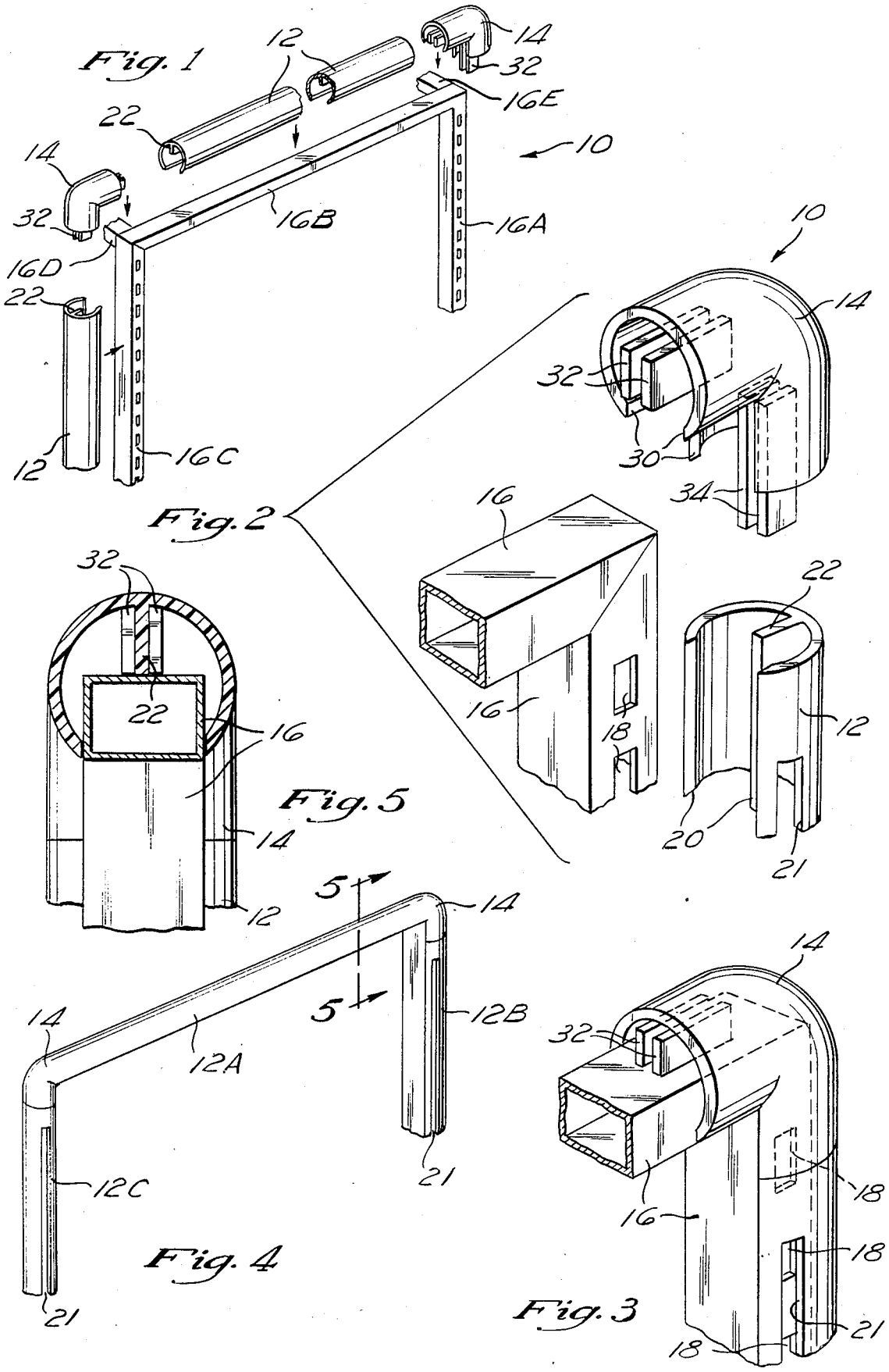
FIG. 1 is an exploded perspective view of the improved merchandise display rack covering system of the present invention.
FIG. 2 is an enlarged exploded view of the improved merchandise rack covering system of the present invention illustrating the manner in which the cover element and corner element are positioned for installation upon the merchandise rack.
FIG. 3 is an enlarged perspective view illustrating the manner in which the cover element and corner element of the present invention are installed upon the merchandise rack.
FIG. 4 is a perspective view depicting the merchandise rack covering system of the present invention installed upon the merchandise rack.
FIG. 5 is a cross-sectional view taken about line 5—5 of FIG. 4.

Referring generally to FIGS. 1–5, the improved merchandise rack covering system of the present invention, designated generally by the numeral 10, is composed of one or more elongate cover elements 12 and corner elements 14 which are adapted to be rapidly positioned upon and affixed to a conventional metal rack, i.e. tandem rack, merchandise display device. As is well known, such conventional metal rack devices 16 are formed from plural interconnected metal tubular sections 16A, 16B and 16C (as shown in FIG. 1). Each of the sections 16A–16C are provided with plural elongate slots 18 on the front side thereof which are utilized to receive one or more interconnecting members, mounting brackets or shelves (not shown) suitable to mount and display merchandise upon the rack 16. Such metal rack segments 16A–16C may be formed having differing sizes but typically are formed having a rectangular cross-sectional configuration sized to be one inch by three-quarters of an inch.

As shown, the cover element 12 is preferably formed as a tubular member having a generally C-shaped cross-sectional configuration including an elongate slot or opening 20 extending axially throughout its length. A second elongate slot, or access slot 21, extends axially throughout most of the length of the cover element 12, terminating at points laterally inboard of the cover element distal ends, and is located on the front face of the cover element, i.e., at an angular position on the central axis of the cover element 90 degrees from the center line of the elongate slot 20. The access slot 21 is positioned and sized to allow the mounting hooks or fixtures of the brackets or shelves to pass therethrough and be received by the elongate slots 18 on the metal tubular section 16A and 16C when the cover element 12 is positioned upon the rack 16. Additionally, a spacer member or wall 22 extends axially throughout the length of the cover member 12 extending radially inward from a location opposite the center line of the slot 20 and terminating within the interior of the cover element 12. The slot 20 is sized to have an effective width slightly less than the width of the rack segments 16A–16C of the merchandise rack 16 such that the cover element 12 may be mounted upon and be frictionally retained upon the merchandise rack 16. Additionally the radial length of the internal spacer 22 is sized to abut the outer edge of the rack 16 when the spacer element 22 is positioned thereupon to prevent the edges of the cover element 12 adjacent the slot 20 from extending inboard beyond the inward edge of the merchandise rack 16.

The corner element 14 is preferably formed in a conventional L-shaped elbow configuration having an external cross-sectional configuration analogous to the cross-sectional configuration of the cover element 12. An L-shaped slot or opening 30 is additionally provided along the inward edges of the corner element 14 which slot 30 is sized to have the same effective width as the slot 20 sized in the cover element 12. Two pairs of side-by-side or parallel guide spacers 32 and 34 are additionally provided within the interior of the element 14 sized to have a radial length equal to the radial length of the guide 22 of the cover element 12. As opposed to the spacer member 22, the two guide spacers pairs 32 and 34 are laterally offset from the central axis of the element 14, each on opposite sides thereof, by a combined distance slightly greater than the thickness of the spacer member 22 to allow the spacer member 22 to slide therebetween. The two pairs of parallel guide spacers 32 and 34 extend laterally outboard beyond the ends of the corner element 14 as best depicted in FIG. 2.

Preferably, the cover element 12 and corner element 14 are formed from a plastic material such as polyvinylchloride (PVC) such that they possess substantial rigidity in their axial length yet are moderately flexible or resilient in a radial direction to enable the same to be positioned upon the rack 16. Further, such plastic material enables the cover element 12 to be economically extruded in desired lengths while the corner element 14 may be economically molded as by way of conventional injection molding fabrication techniques. In addition, the use of such plastic materials enables various color resins or additives to be added during the fabrication process to enable the cover element 12 and corner element 4 to be formed in differing colors suitable for merchandise display decors.

With the structure defined, the method of installing the improved merchandise rack covering system 10 of the present invention may be described with specific reference to FIGS. 2, 3, and 5. As shown in FIG. 2, initially a corner element 14 is positioned adjacent a corner of the merchandise rack 16 such that its slot 30 is aligned with the corner of the rack 16. Subsequently, the corner element 14 may be pressed inwardly upon the corner of the merchandise rack 16 wherein, due to the moderate flexibility of the plastic material of the corner element 14, the slot 30 moderately opens such that the edges of the slot 30 slidingly contact the side surfaces of the merchandise rack 16. This sliding movement continues until such time as the inward edges of the two pairs of guide spacers 32 and 34 directly contact and abut the outboard edges of the rack 16 wherein further inward movement of the corner element 14 relative the rack 16 is prohibited. As will be recognized, due to the memory property of the plastic material utilized in the elbow 14, the edges of the slot 30 frictionally engage the side edges of the rack 16 to mount the corner element 14 tightly upon the rack 16. Further, it will be recognized that the slot 30 self-registers the corner element 14 upon the rack 16. Subsequently, an additional corner element 14 may be positioned upon the rack 16 adjacent the opposite corner of the rack in an analogous manner as depicted in FIG. 4.

With the corner elements 14 mounted upon the rack 16, a first length 12A of the cover element 12 (shown in FIG. 4) may be cut to length to extend tightly between the corner elements 14 disposed upon the rack 16. Once cut, the slot or opening 20 formed in the cover element 12 may be positioned adjacent the top edge of the rack 16 and the cover element 12A may be pressed downwardly upon the rack 16 such that the edges of the opening 20 contact the outer side surfaces of the rack 16. Such downward movement will continue until such time as the distal end of the spacer member 22 contacts the outboard side of the rack 16 as depicted in FIG. 5. Subsequently, additional cover elements 12B and 12C may be cut to length in a manner previously described and positioned upon a respective segment of the merchandise rack 16 as depicted in FIG. 4.

As will be recognized, when the cover element 12 is positioned on the rack 16, the lateral space between the two individual members of the spacer pairs 32 and 34 allows the guide member 22 to be positioned therebetween so that the cover member 12 is automatically registered relative to the corner element 14 as depicted in FIG. 5. As such, the cover elements 12 and corner elements 14 are rapidly frictionally mounted and registered relative the rack 16. Further, due to the access slot 21 formed in the cover element 12 a complete series of the slots 18 formed in the rack 16 are unobstructed after mounting of the system 10 upon the rack 16 such that the rack may be utilized for its desired purpose without any obstruction.

Although for purposes of illustration certain sizes and configurations of elements have been defined herein, those having ordinary skill in the art will recognize that various modifications to the same can be made without departing from the spirit of the present invention and such modifications are clearly contemplated herein.

What is claimed is:

1. A covering system for a merchandise rack having a rack element comprising:

a cover element comprising an elongate tubular member having a first axial slot and a second axial slot extending along its length;

at least one corner element having a distal end in abutting relationship with said cover element and further comprising a generally L-shaped tubular member having an L-shaped slot extending along its length; and spacer means extending within the interior of said cover element and said corner element, said first axial slot and said L-shaped slot frictionally engaging the rack element of the merchandise rack and said spacer means abutting said rack element when said cover element and said corner element are positioned upon said merchandise rack.

2. The covering system of claim 1 wherein said first axial slot and said L-shaped slot are sized to have an effective width slightly less than the width of said rack element.

3. The covering system of claim 2 wherein said second axial slot is sized and positioned to allow mounting brackets to pass therethrough and be mounted on said rack element.

4. The covering system of claim 3 wherein said spacer means comprises a wall extending radially inward within the interior of said cover element and a pair of laterally-spaced walls extending radially inward within the interior of said corner element.

5. The covering system of claim 4 wherein said spacer means formed on said corner element extends axially outward beyond the distal ends of said cover element.

6. The covering system of claim 5 wherein the space between said laterally-spaced walls on said corner element is sized to allow said spacer means of said cover element to fit therein when said cover element and corner element are positioned on said merchandise rack.

7. The covering system of claim 6 wherein said cover element and said corner element are formed of a plastic material.

8. The covering system of claim 7 wherein said plastic material comprises polyvinylchloride.

9. The covering system of claim 8 wherein said covering element is formed by extrusion.

10. The covering system of claim 8 wherein said corner element is formed by injection molding.

* * * * *